United States Patent [19]

Kozacka

[11] 4,041,525

[45] Aug. 9, 1977

[54] ELECTRIC FUSE AND PROCESS OF MANUFACTURING THE SAME

[75] Inventor: Frederick J. Kozacka, South Hampton, N.H.

[73] Assignee: The Chase-Shawmut Company, Newburyport, Mass.

[21] Appl. No.: 673,375

[22] Filed: Apr. 5, 1976

[51] Int. Cl.[2] ..... H01H 85/04

[52] U.S. Cl. ..... 337/295; 337/229; 337/248; 337/293

[58] Field of Search ..... 337/159-162, 337/229, 247, 248, 290, 293, 295

[56] References Cited

U.S. PATENT DOCUMENTS

| | | | |
|---|---|---|---|
| 1,094,030 | 4/1914 | Sprong et al. | 337/229 |
| 2,067,977 | 1/1937 | Muncheryan | 337/295 X |

FOREIGN PATENT DOCUMENTS

| | | | |
|---|---|---|---|
| 1,128,536 | 4/1962 | Germany | 337/248 |
| 505,388 | 5/1939 | United Kingdom | 337/293 |

*Primary Examiner*—Robert J. Hickey
*Attorney, Agent, or Firm*—Erwin Salzer

[57] ABSTRACT

An electric fuse having blind metal fusion joints, e.g. solder joints, between the two ferrules and the fusible element, or the fusible elements, thereof. One of these conductive connection joints is situated adjacent the center region of the inner end surface of one of the two ferrules. The other of these conductive connection joints is situated between one of the rims of the casing and the peripheral region of the inner end surface of the other of the two ferrules.

8 Claims, 5 Drawing Figures

ELECTRIC FUSE AND PROCESS OF MANUFACTURING THE SAME

BACKGROUND OF THE INVENTION

This invention refers to electric fuses having a tubular casing of electric insulating material which is closed on the ends thereof by ferrules, or terminal caps. The ferrules, or terminal caps, are conductively interconnected by one or more fusible elements. The ends of a fusible element or of fusible elements are generally conductively connected to the ferrules either by spot welds, or by solder joints. There are a great many ways of establishing electrically conductive joints. Solder joints of the kind under consideration are classified into two classes, of which one class is referred to as blind solder joints. Blind solder joints are generally not visible. Therefore fuses having blind solder joints have generally a better appearance than fuses having solder joints which are visible from the outside thereof. As a rule, fuses having blind solder joints are less reliable than fuses having visible solder joints because, generally, the soldering process cannot be observed while the solder joints are made, and because a defect in a blind solder joint may not readily be discovered by quality control. Conventional blind solder joints have a high ratio of non-satisfactory joints to satisfactory joints. This is also due to the fact that when making conventional blind solder joints the parts to be soldered together cannot be held in engagement under pressure while the joint is made.

It is, therefore, the prime object of this invention to provide electric fuses including blind electrically conductive joints between the ferrules and the ends of the fusible element or elements which fuses are not subject to the above limitations. Another object of this invention is to provide fuses wherein electrically conductive joints formed between the ends of the fusible element or elements and the ferrules are not visible from the outside of the fuse structure and can be made cost effectively with a high degree of reliability.

Other objects and advantages of the invention will become more apparent as this specification proceeds.

SUMMARY OF THE INVENTION

Fuses embodying this invention include a tubular casing of electric insulating material having a pair of rims at the axially outer ends thereof. There is a granular arc-quenching filler inside the casing. A pair of ferrules each having an axially inner end surface is mounted on said casing and closes the ends thereof. The casing houses fusible element means embedded in said arc-quenching filler. One end of the fusible element means is arranged adjacent the center region of said axially inner end surface of one of said pair of ferrules and conductively connected by a first metal fushion joint to said center region, and the other end of said fusible element means is angularly bent, rests on one of said pair of rims of said casing, and is conductively connected by a second metal fusion joint to the peripheral region of said axially inner end surface of the other of said pair of ferrules.

DESCRIPTION OF PREFERRED EMBODIMENTS

Figure 1:
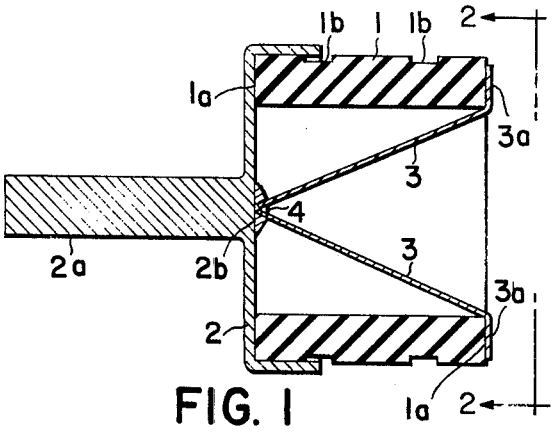
FIG. 1 is a longitudinal section of some parts in the process of assembly of a fuse embodying this invention.
Figure 2:
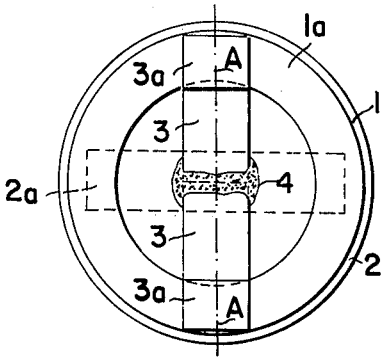
FIG. 2 is a section along 2—2 of FIG. 1 or, in other words, a view of the structure of FIG. 1 seen from right to left of FIG. 1.

In the drawings reference numeral 1 has been applied to indicate a tubular casing of electric insulating material having a pair of circular rims 1*a* at the axially outer ends thereof. Ferrule 2 provided with a blade contact 2*a* is mounted on the left end of casing 1 and closes the left end thereof. One or more fusible elements 3 are arranged inside of casing 1. As shown in FIG. 1 and FIG. 2 two ribbon fuse links 3 are arranged in V-formation inside of casing 1. The ribbon fuse links 3 are arranged in a slanting way inside of casing 1 in such a fashion that their left ends are coextensive with the center region 2*b* of the inner end surface of ferrule 2. A first solder joint 4 conductively connects the left ends of ribbon fuse links 3 to the center region 2*b* of the inner end surface of ferrule 2. The right ends 3*a* of ribbon fuse links 3 are angularly bent and rest on the right rim 1*a* of casing 1.

Figure 3:
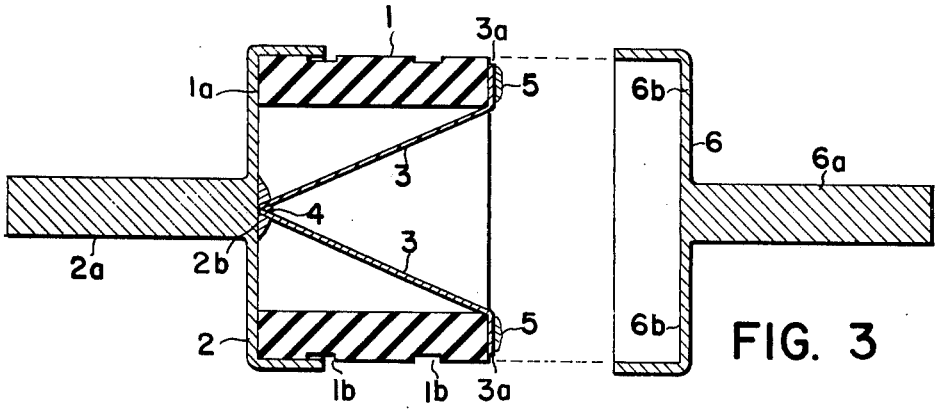
FIG. 3 is a longitudinal section of the same parts as shown in FIG. 1 in a more advanced state of assembly.

FIG. 2 is identical with FIG. 1, except that the former shows two layers of paste solder 5 on the ends of fusible elements 3 which rest upon the right rim 1*a* of casing 1. FIG. 3 further shows in the way of an exploded view a second ferrule 6 having a blade contact 6*a* which ferrule is intended to be mounted on the right end of casing 1. Prior to this casing 1 is filled with a granular arc-quenching filler 7, e.g. quartz sand. When ferrule 6 is mounted on the right end of casing 1, the peripherally outer portion 6*b* of the inner end surface of ferrule 6 engages under pressure the paste solder blobs 5 on ends 3*a* of fusible elements 3 and compress the same. As a result, they spread evenly over the ends 3*a* of the fusible elements 3 which rest upon rim 1*a* of casing 1. Upon heating of ferrule 6 from the outside thereof the paste solder 3 melts and establishes a conductive connection between the right ends 3*a* of fusible elements 3 and the peripheral region of the inner end surface of ferrule 6. This solder operation can be performed under pressure and tends to result in an effective solder joint. In similar fashion the operation establishing solder joint 4 can be effected while the left ends of fusible elements 3 engage under pressure the center region of the inner end surface of ferrule 2. Thus all solder joints 4,5 tend to be highly reliable, though they are solder joints which are not visible from the outside of the fuse structure, i.e. are blind solder joints.

While the drawings show an embodiment of the invention which includes two fuse links 3 connected in parallel, the number of fuse links may be decreased, or increased, as desired, depending upon the current-carrying capacity which the particular embodiment of the invention is intended to have.

It will be apparent, particularly from FIG. 2, that the two ribbon type fuse links 3 are arranged at right angles to the median plane A—A of casing 1.

The bent at the right end 3*a* of fusible elements 3 resting upon rim 1*a* of casing 1 may either be preformed, or formed during the assembly of the fuse. The fusible elements 3 may be provided with incisions or perforations (not shown) as generally practiced in the fuse art to establish points of increased current density where fusing $i^2 \cdot ts$ are minimized.

Figure 4:
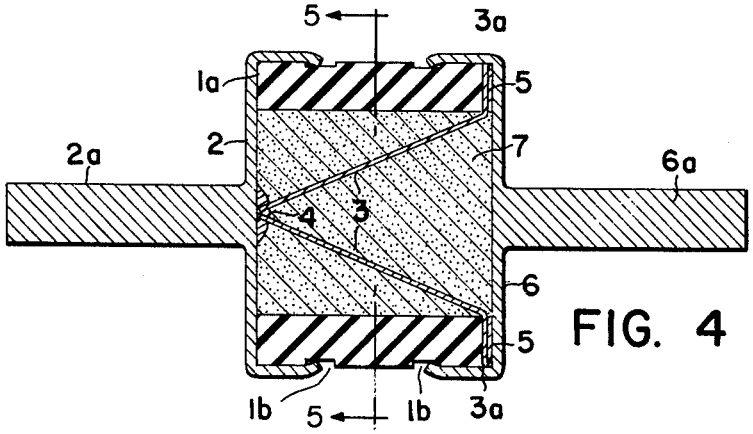
FIG. 4 is a longitudinal section of the structure of FIGS. 1 and 3 upon complete assembly thereof.

Casing 1 is provided with circular grooves 1*b* as shown in FIG. 1, into which the axially inner ends of the lateral surfaces of ferrules 2 and 6 may be crimped, as shown in FIG. 4.

The process of assembling a fuse according to the present invention includes the following steps. First ferrule 2 is mounted on casing 1 as shown in FIG. 1. Then one or more fusible elements are inserted into casing 1 as shown in FIGS. 1 and 3, i.e. so that each fusible element slants from the center region 2*b* of the inner end surface of ferrule 2 to a point on the right rim 1*a* of casing 1. The next step consists in establishing a solder joint 4— e.g. by means of paste solder — between the fusible element, or elements 3 and the center region 2*b* of the inner end surface of ferrule 2. Now the inside of casing 1 is filled with the granular arc-quenching filler 6, whereupon paste solder 5 is applied to the right ends 3*a* of fusible elements 3. It will be noted that FIG. 3 shows the presence of paste solder 5 without the filling of the casing 1 with the granular arc-quenching filler 7. FIG. 3 has been drawn in this fashion to better illustrate the presence of the paste solder 5 before it has been spread out by mounting of ferrule 6 on casing 1. Actually the filling of casing 1 with pulverulent arc-quenching filler 7 ought to precede the application of paste solder 5.

After filling casing 1 with granular arc-quenching filler 7 and mounting ferrule 6 on casing 1, the point, or points 3*a* of the fusible element, or elements 3 are clamped together with the paste solder 5 between the rim 1*a* of casing 1 and the peripheral region 6*b* of the inner end surface of ferrule 6. Now the ferrule 6 is heated from the outside thereof to cause fusion of the paste solder 5 and formation of internal solder joints between the ends 3*a* of fusible elements 3 and ferrule 6.

Figure 5:
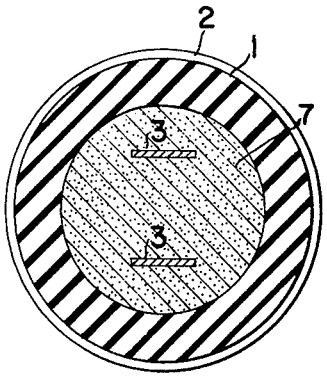
FIG. 5 a section along 5—5 of FIG. 4.

In the case that the fuse is provided with two fusible elements 3 which are connected in parallel — as shown in FIGS. 1-5 — the fusible elements 3 ought to be of equal length and, therefore, the solder joint 4 ought to be as close as possible to the center of the axially inner end surface of ferrule 2. The same applies in case that the fuse includes more than two, e.g. three or four fusible elements. If the fuse includes but one single fusible element 3, the solder joint 4 may be more or less off center of the axially inner end surface of ferrule 2 or, in other words, in that particular instance the solder joint 4 may be positioned at any point of the axially inner end surface of ferrule 2 as long as solder joint 4 is positioned radially inwardly from the left rim 1*a* of casing 1 as seen in FIGS. 1,3 and 5.

The invention is not limited to fuses whose fusible elements are conductively connected to the ferrules by means of soft solder joints, but encompasses also fuses wherein the above conductive connections are effected by means of welds, in particular spot-welds. Thus solder joint 4 may be replaced by a pair of spot-welds conductively connecting fusible elements 3 to ferrule 2. In a like fashion the diverging ends of fusible elements 3 may be welded to ferrule 6, thus replacing solder joints 5.

The term "metal fusion joint" which has been applied above as well as in the following claims is intended as a generic term encompassing soft solder joints as well as welds.

I claim as my invention:

1. An electric fuse including a. a tubular casing of electric insulating material having a pair of circular rims at the axially outer ends thereof;

b. a granular arc-quenching filler inside said casing;

c. a pair of ferrules each having an axially inner end surface mounted on the ends of said casing and closing said ends thereof; and d. fusible element means in ribbon form embedded in said arc-quenching filler, one end of said fusible element means being arranged adjacent the center region of said axially inner end surface of one of said pair of ferrules and conductively connected by a first metal fusion joint to said center region, and the other end of said fusible element means being angularly bent, resting on one of said pair of rims of said casing and being conductively connected to the peripheral region of said axially inner end surface of the other of said pair of ferrules by a second metal fusion joint.

2. An electric fuse as specified in claim 1 including a plurality of fusible element means in ribbon form arranged in V-formation inside said casing.

3. An electric fuse as specified in claim 1 wherein said first metal fusion joint and said second metal fusion joint are soft solder joints.

4. An electric fuse as specified in claim 1 wherein said first metal fusion joint and said second metal fusion joint are welds.

5. An electric fuse including a. a tubular casing of electric insulating material having a pair of circular rims at the axially outer ends thereof;

b. a granular arc-quenching filler inside said casing;

c. a pair of ferrules mounted on the ends of said casing and closing the ends thereof, each of said pair of ferrules having an axially inner end surface; and d. a fusible element in form of a metal ribbon embedded in said arc-quenching filler, one end of said fusible element being arranged at a point situated radially inwardly from one of said pair of rims of said casing and immediately adjacent to said axially inner end surface of one of said pair of ferrules and conductively connected by a first metal fusion joint to said one of said pair of ferrules, and the other end of said fusible element being bent angularly at a point situated immediately adjacent to and resting on the other of said pair of rims of said casing, and said other end of said fusible element being conductively connected by a second metal fusion joint to a region of said axially inner end surface of said other of said pair of ferrules.

6. An electric fuse as specified in claim 5 wherein both said first metal fusion joint and said second metal fusion joint are soft solder joints.

7. An electric fuse as specified in claim 5 wherein both said first metal fusion joint and said second metal fusion joint are spot-welds.

8. An electric fuse including a. a tubular casing of electric insulating material having a pair of rims on the axially outer ends thereof;

b. a granular arc-quenching filler inside said casing;

c. a pair of ferrules mounted on the ends of said casing and closing said ends, each of said pair of ferrules having an axially inner end surface; and d. a pair of ribbon type fuse links embedded in said arc-quenching filler and arranged at right angles to a common median plane of said casing, one end of each of said pair of fuse links being positioned adjacent the center region of said axially inner end surface of one of said pair of ferrules and conductively connected by a metal fusion joint to said one of said pair of ferrules, and the other end of each of said pair of fuse links being angularly bent adjacent one of said pair of rims of said casing, positioned at angularly displaced points on said one of said pairs of rims of said casing and conductively connected by a metal fusion joint to the peripheral region of said axially inner end surface of the other of said pair of ferrules.

* * * * *